US005799373A

United States Patent [19]

Dickeduisberg

[11] Patent Number: 5,799,373

[45] Date of Patent: Sep. 1, 1998

[54] PIVOT HINGE

[75] Inventor: Ingolf Dickeduisberg, Soest, Germany

[73] Assignee: Eva Lahrmann, Soest, Germany

[21] Appl. No.: 582,256

[22] Filed: Jan. 3, 1996

[30] Foreign Application Priority Data

Jan. 4, 1995 [DE] Germany ..... 195 00 139.7

[51] Int. Cl.[6] ..... E05D 7/081

[52] U.S. Cl. ..... 16/358

[58] Field of Search ..... 16/357, 358, 360, 16/361

[56] References Cited

U.S. PATENT DOCUMENTS

| | | | |
|---|---|---|---|
| 814,355 | 3/1906 | Carter | 16/358 |
| 1,115,345 | 10/1914 | Steurnagel | 16/358 |
| 1,832,174 | 11/1931 | Zahner et al. | 16/358 |
| 2,143,704 | 1/1939 | Kufner | 16/358 |
| 2,793,387 | 5/1957 | Odell | 16/358 |
| 2,855,504 | 10/1958 | MacDougall et al. | 16/357 |

FOREIGN PATENT DOCUMENTS

| | | | |
|---|---|---|---|
| 233161 | 11/1959 | Australia | 16/359 |
| 866352 | 4/1941 | France | 16/361 |
| 2405626 | 6/1979 | France | 16/358 |
| 452068 | 10/1949 | Italy | 16/358 |
| 458156 | 2/1951 | Italy | 16/358 |
| 497255 | 11/1955 | Italy | 16/358 |

*Primary Examiner*—Chuck Mah
*Assistant Examiner*—Donald M. Gurley
*Attorney, Agent, or Firm*—Herbert Dubno; Andrew Wilford

[57] ABSTRACT

A pivot hinge usable to support a swingable panel relative to a stationary support has a panel plate mounted on the panel and a support plate mounted on the support. The panel plate is provided with a panel pin projecting along an axis away from the panel and formed with a groove open axially away from the panel and elongated transversely of the axis. The support plate is provided with a support pin projecting along an axis parallel to the panel-pin axis toward the panel plate and engaged in the panel-plate groove and is formed with a groove open axially toward the panel, elongated transversely of the axes, and receiving the panel pin. Thus as the panel is swung relative to the support both pins move along the respective grooves.

10 Claims, 9 Drawing Sheets

PIVOT HINGE

FIELD OF THE INVENTION

The present invention relates to a pivot hinge. More particularly this invention concerns such a hinge used in a swinging door.

BACKGROUND OF THE INVENTION

It is standard to provide a swinging door, or even a window or other movable panel, with a pivot hinge that allows the door to be swung out of the way. In a standard system simple pivot pins mounted on the top and bottom corners of the door engage in floor- and ceiling-mounted plates so that the door can pivot in both directions, through at least 180° about the axis defined by the two pins which are coaxial. This system is effective and simple, but normally requires the vertical hinge edge of the door to be rounded and/or spaced somewhat from its jamb to provide the necessary clearance.

In an improved system described in U.S. Pat. No. 2,143,704 of Kufner the hinge includes a pair of parallel but transversely spaced pins mounted on the door and a plate having a pair of separate and adjacent grooves or guide tracks receiving the respective pins. By appropriate dimensioning and positioning of the pins and tracks it is possible to somewhat reduce the swing of the door so that it can be made to fit somewhat more tightly in its opening. Nonetheless considerably more spacing must be provided than for a conventional door.

OBJECTS OF THE INVENTION

It is therefore an object of the present invention to provide an improved pivot hinge.

Another object is the provision of such an improved pivot hinge which overcomes the above-given disadvantages, that is which is simple and that allows the door to fit snugly in its jamb.

SUMMARY OF THE INVENTION

A pivot hinge usable to support a swingable panel relative to a stationary support has according to the invention a panel plate mounted on the panel and a support plate mounted on the support. The panel plate is provided with a panel pin projecting along an axis away from the panel and formed with a groove open axially away from the panel and elongated transversely of the axis. The support plate is provided with a support pin projecting along an axis parallel to the panel-pin axis toward the panel plate and engaged in the panel-plate groove and is formed with a groove open axially toward the panel, elongated transversely of the axes, and receiving the panel pin. Thus as the panel is swung relative to the support both pins move along the respective grooves.

By providing one of the grooves and one of the trunnion pins on one of the plates and the other groove and pin on the other plate, it is possible to orient the two grooves relative to each other to define a very advantageous swing. The two grooves can and indeed according to this invention do cross each other, seen parallel to the pin axes, so that a complex compound movement is possible that in effect combines lateral shifting and pivoting, making it possible for the panel to move into and out of an opening in which it fits very snugly. In fact the transverse width of the door opening can be smaller than the diagonal dimension viewed from above of the door itself.

According to the invention the grooves have outer ends in which the respective pins engage in a closed position of the panel and opposite inner ends in which the respective pins engage in an open position of the panel. The pins move toward each other on movement of the door from the closed to the open position.

One of the grooves in accordance with the invention is generally straight and the other groove is at least partially circularly arcuate. Alternately both of the grooves are curved. Each of the grooves is provided with a laterally directed opening so that the respective pins can be moved out of the grooves through the respective openings. In addition one of the grooves can have an end portion of reduced size dimensioned to pinch and hold the respective pin. Each of the plates is unitarily formed with the respective groove and the grooves are of uniform widths slightly greater than diameters of the respective pins.

One of the pins can according to the invention be formed by a nonrotatable axle and a roller carried on the axle and engaging the respective groove. The door lies in a plane and the pins are spaced apart parallel to the plane.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

Figure 5:
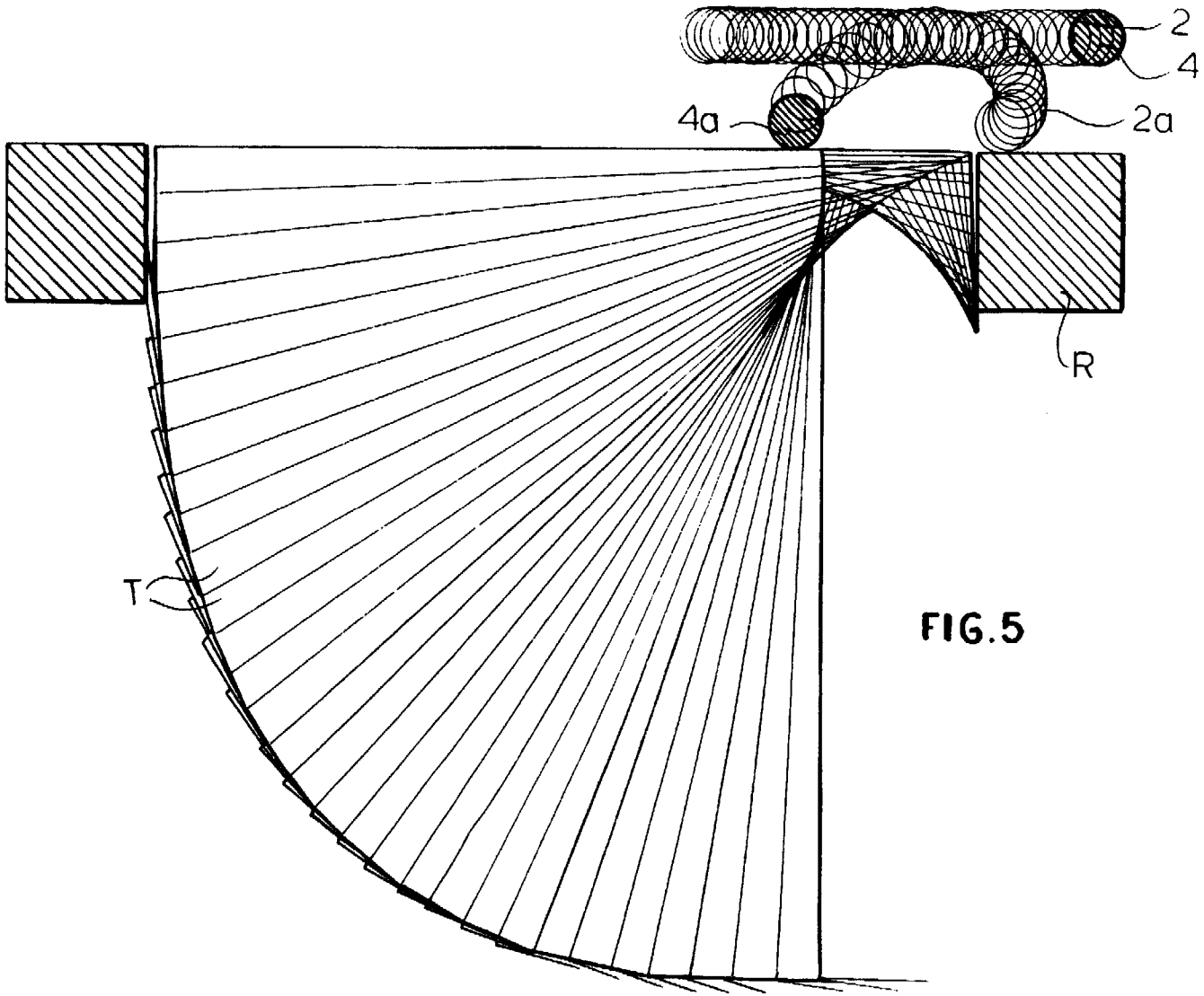
FIG. 5 is a view like FIG. 4 but showing successive positions of the door panel and hinge elements as the door is swung.
Figure 11:
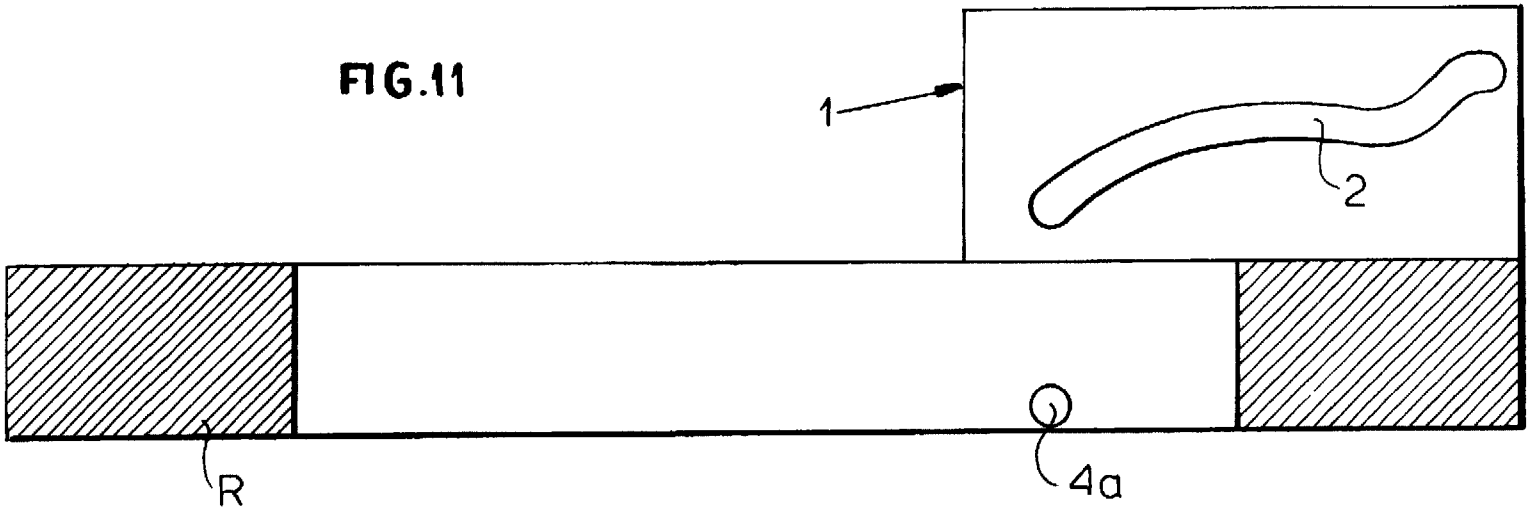
FIGS. 11 and 12 are horizontal sections like FIGS. 2 and 3 through a third embodiment of the hinge.
Figure 12:
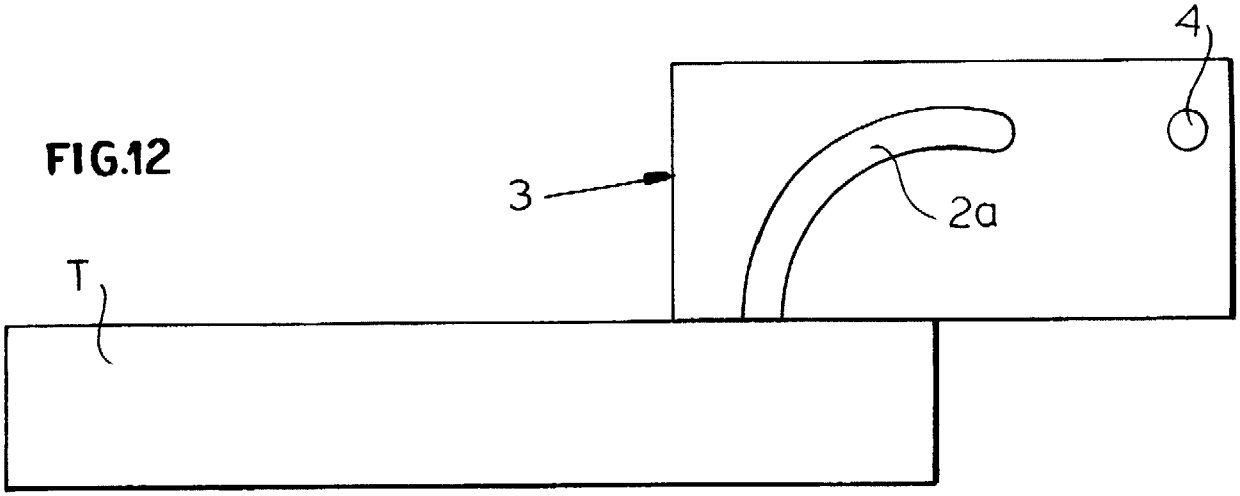

13 is a view like FIG. 5 of the hinge of FIGS. 11 and 12.

SPECIFIC DESCRIPTION

As seen in FIGS. 1 through 5 a pivot hinge according to the invention comprises a plate 1 mounted in a support, here a door frame R, and a plate 3 mounted on an edge, here the lower edge, of a door T. The support plate 1 is formed with a generally straight and upwardly open guide groove or track 2 that extends generally parallel to a plane P of the door T and with an upwardly projecting cylindrical trunnion pin 4*a*. The door plate 3 is formed with a C-shaped and downwardly open groove or track 2*a* that receives the pin 4*a* and with a downwardly projecting cylindrical trunnion pin 4 that is engaged in the groove 2. The transverse widths of the elongated grooves 2 and 2*a* are constant and equal to or slightly wider than the diameters of the respective pins 4 and 4*a*. At least one of the grooves, here the groove 2, is formed at one of its ends with a lateral cutout or opening that allows the door T to be mounted easily.

Figure 1:
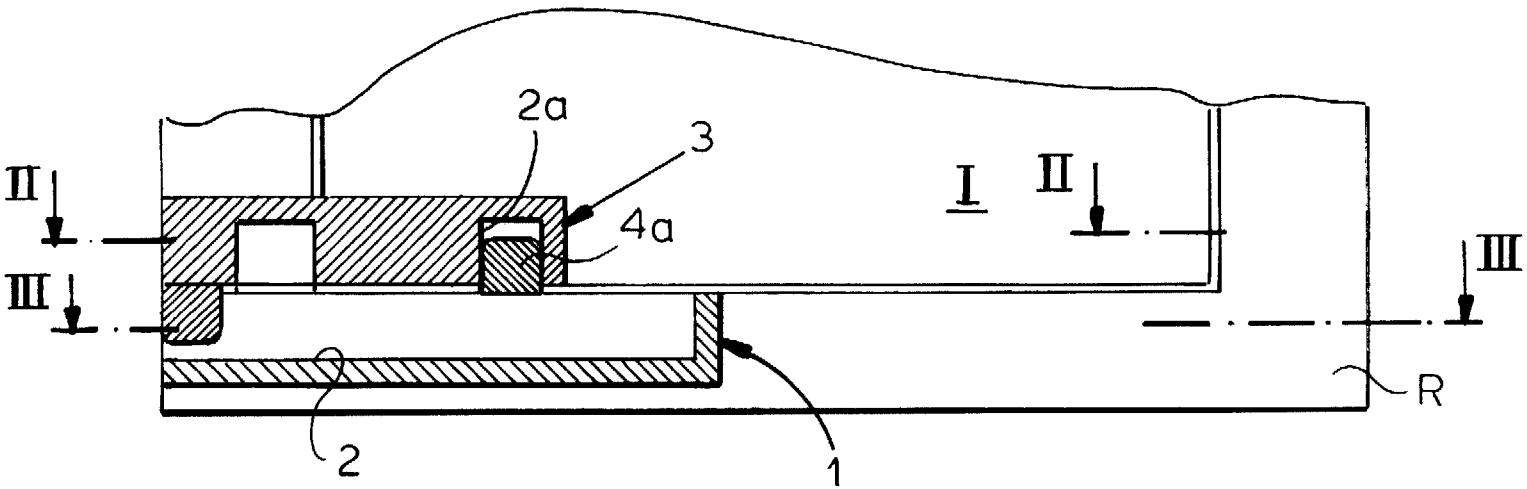
FIG. 1 is a vertical section through a first embodiment of the hinge according to the invention.
Figure 2:
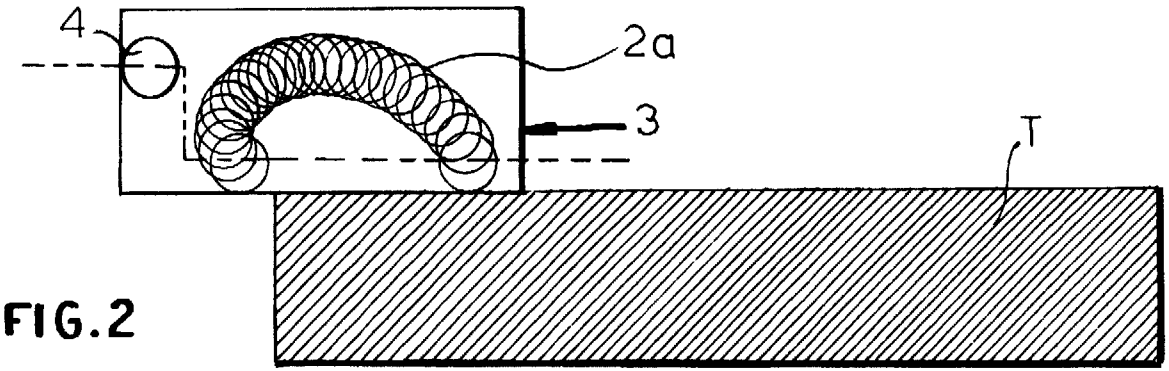
FIGS. 2 and 3 are horizontal sections taken along respective lines II—II and III—III of FIG. 1.
Figure 3:
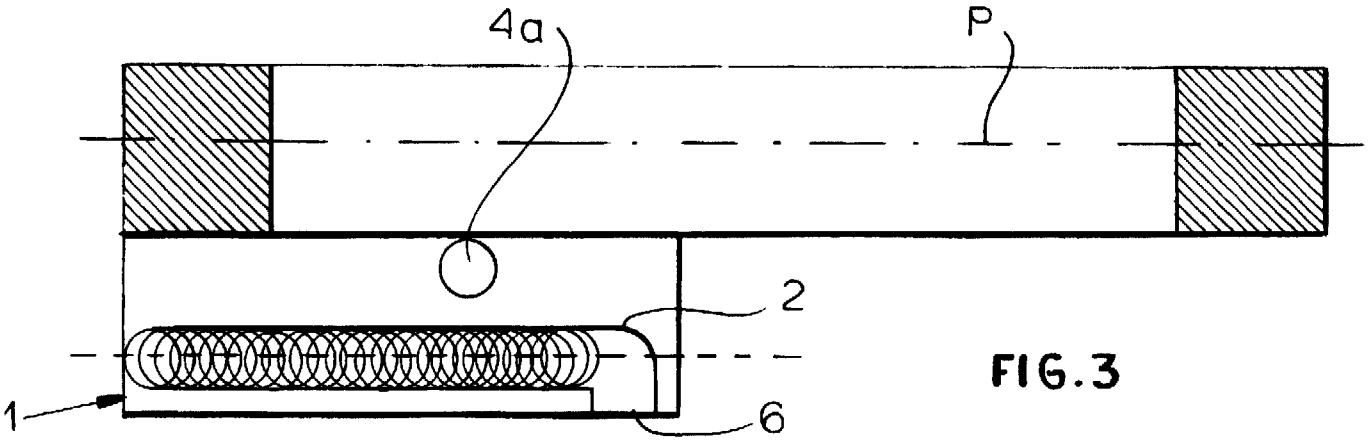
Figure 4:
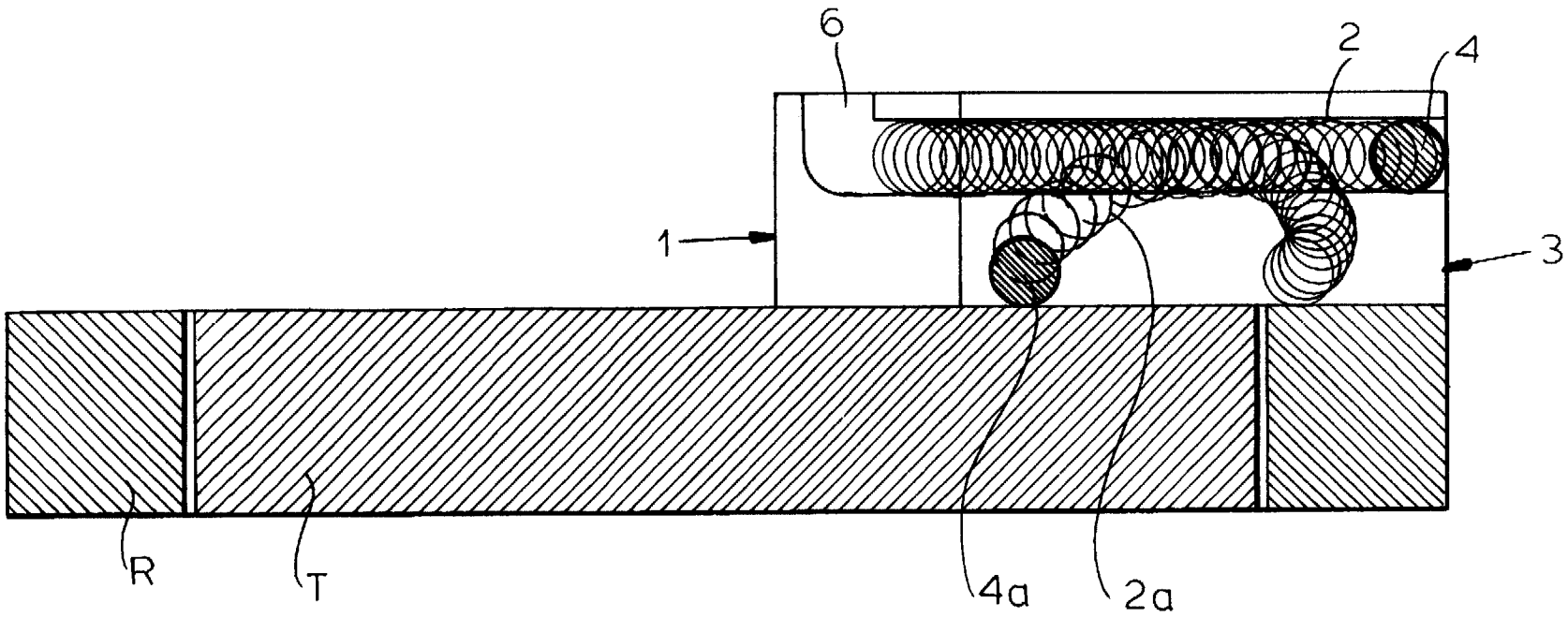
FIG. 4 is a mainly diagrammatic combined sectional view illustrating the relative relationships of the parts of FIGS. 2 and 3.

As seen in FIG. 4 the grooves 2*a* and 2 cross each other seen in a direction parallel to the axes of the pins 4 and 4*a*. As a result when the door T is swung from a closed position fitting in the frame R to an open position perpendicular thereto as shown in FIG. 5 the pins 2 and 4*a* move at first toward each other, with a combined lateral shifting and pivoting movement of the door T that allows it to move out of the jamb R even when it is a fairly snug fit therein.

Figure 6:
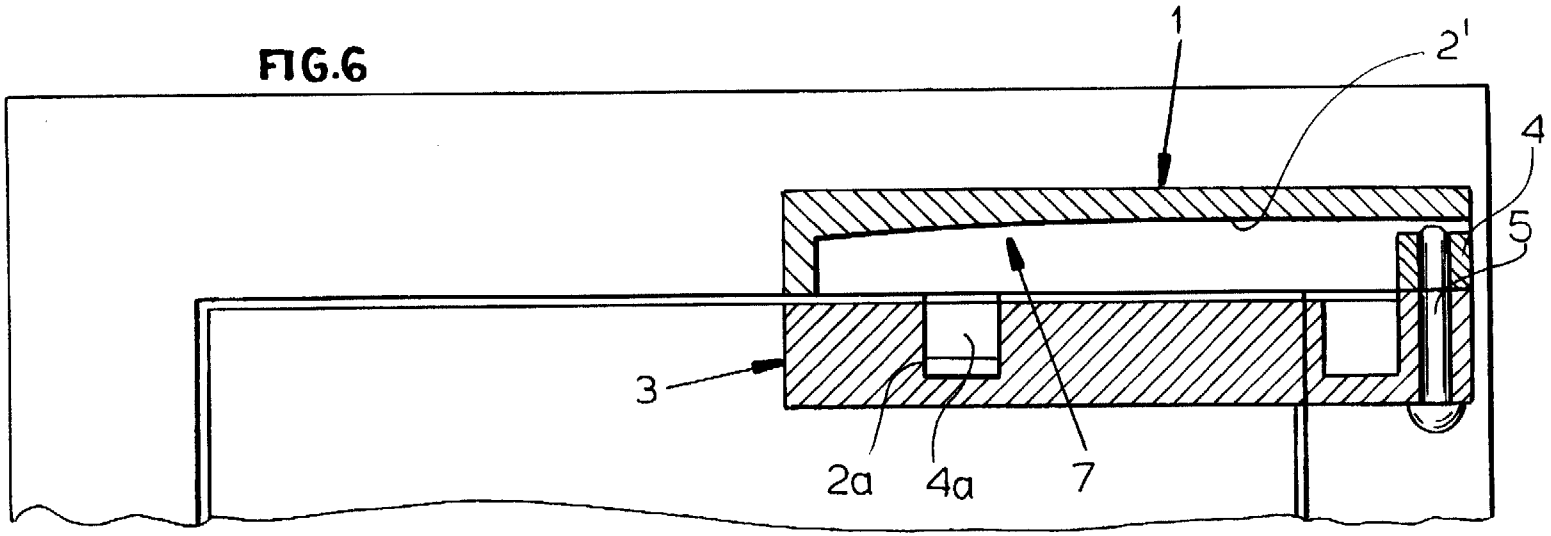
FIG. 6 is a view like FIG. 1 of a top hinge.
Figure 10:
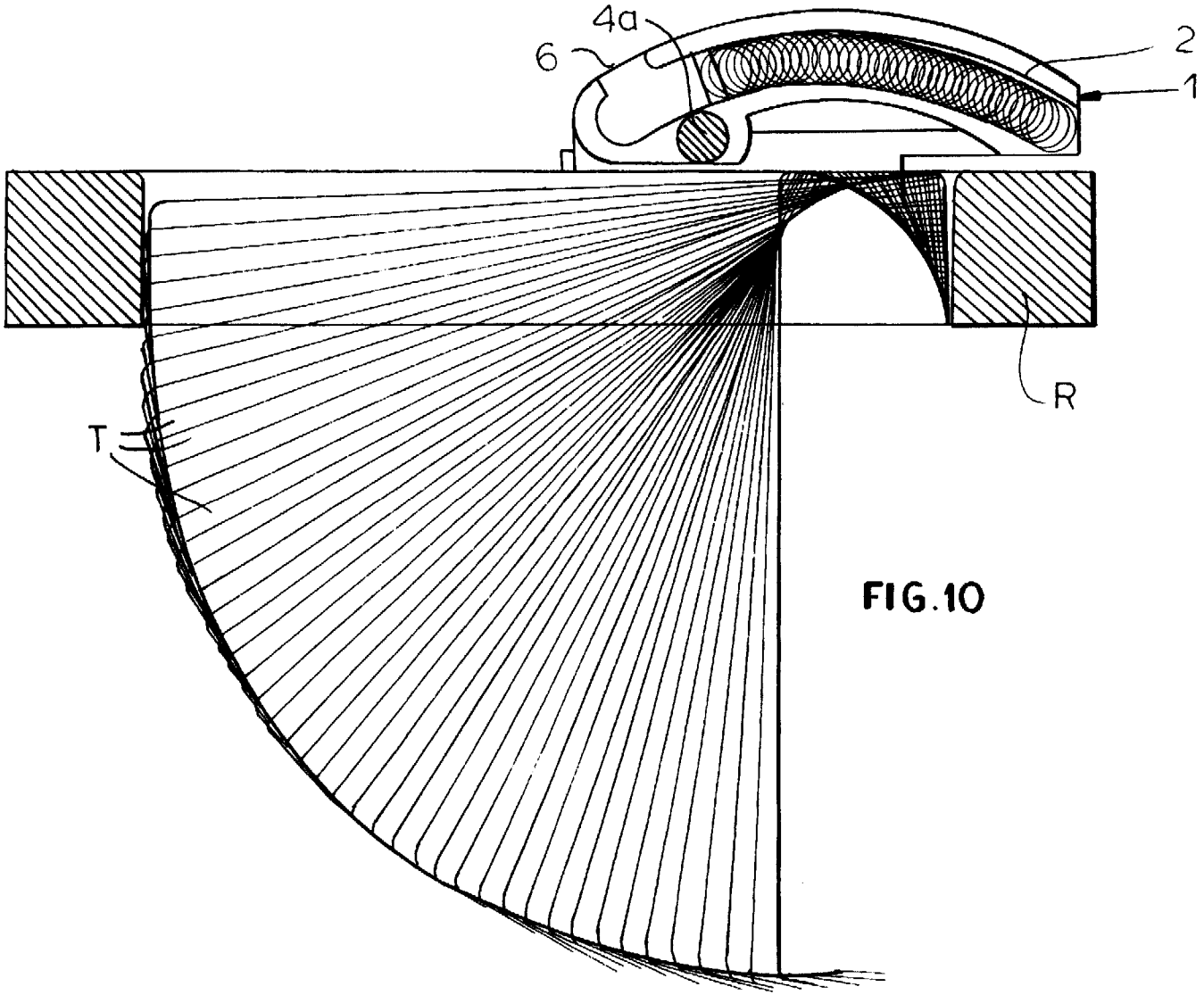

FIG. 6 shows how the groove 2' of a top-hinge support plate 1 can taper outward as shown at 7. This causes a pinching and holding of the pin 4 which here is constructed as a roller on an axle 5.

Figure 7:
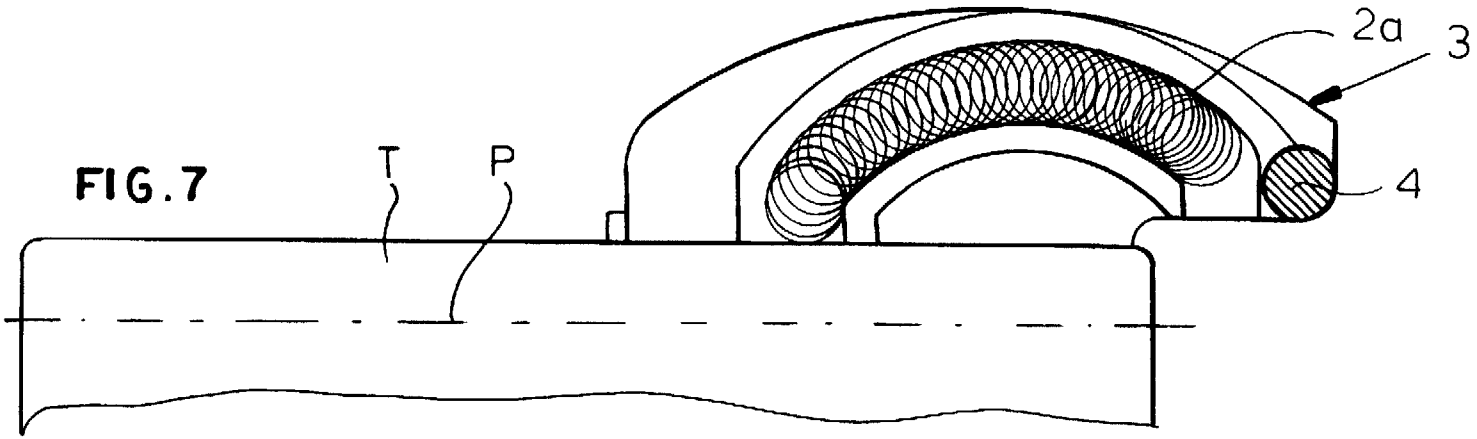
FIGS. 7 and 8 are horizontal sections like FIGS. 2 and 3 through a second embodiment of the hinge.
Figure 8:
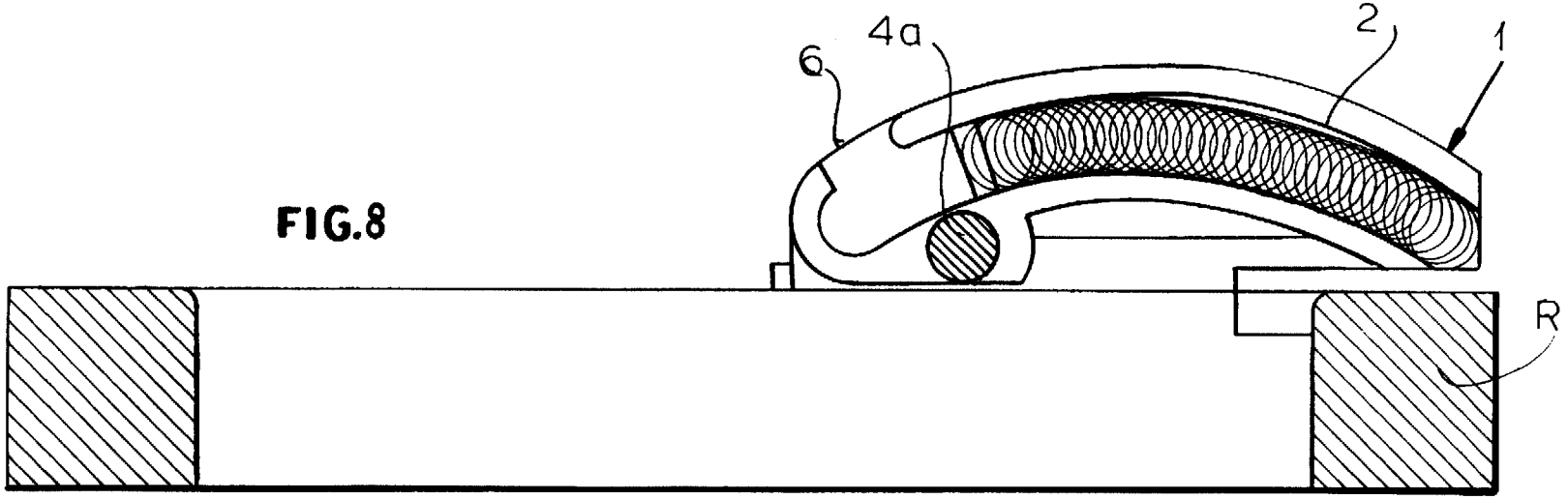
Figure 9:
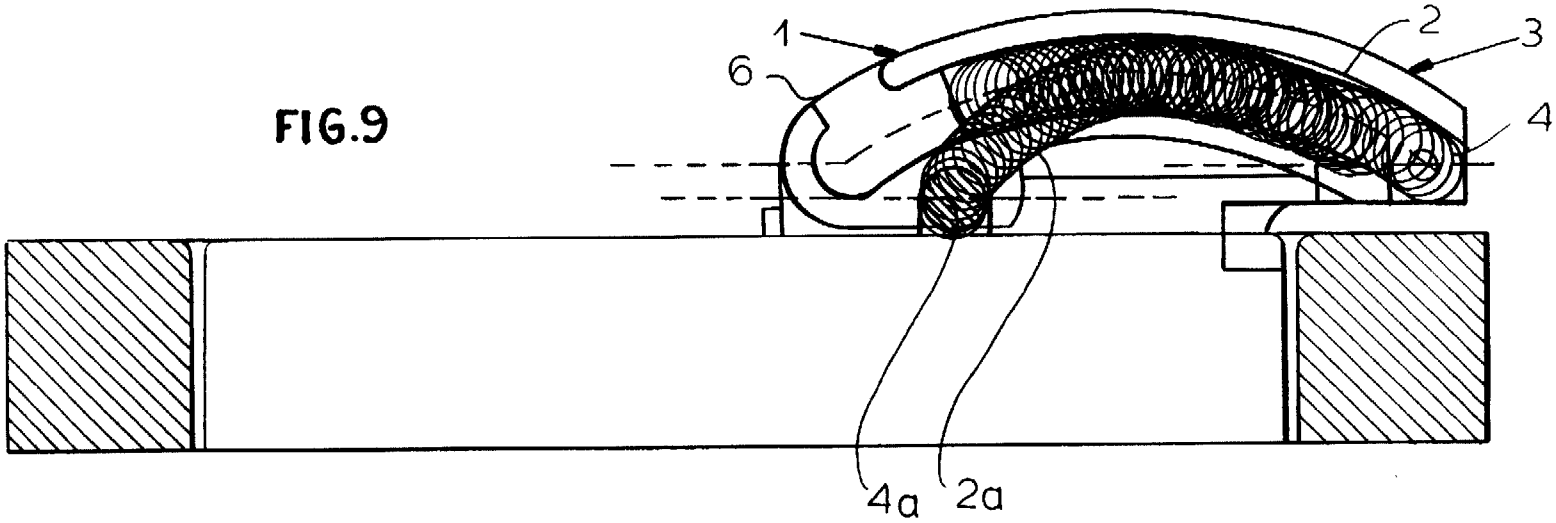
FIGS. 9 and 10 are views like FIGS. 4 and 5 of the hinge of FIGS. 7 and 8.

The system of FIGS. 7 through 9 has both of the tracks formed wholly outside the vertical footprint of the door 2 and both tracks 2 and 2*a* are arcuate. The curvatures are concave in the same direction perpendicular to the door plane P and the groove 2*a* is vertically generally aligned with the groove 2.

Figure 13:
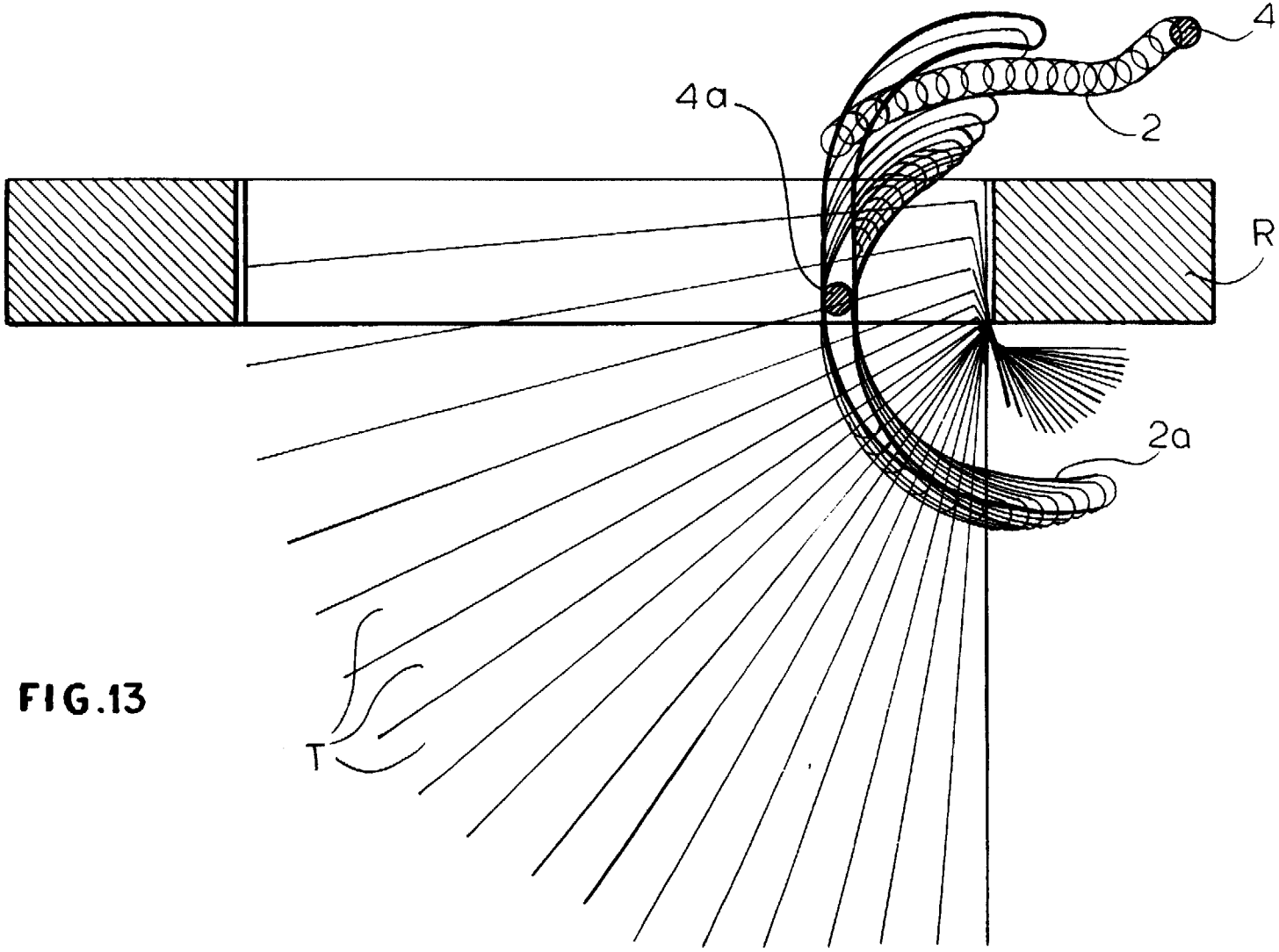

In FIGS. 11 through 13 an S-shaped groove 2 and circularly arcuate groove 2*a* work together to move the door T wholly out of the opening of the frame R when open as shown in FIG. 13. Thus the door T pivots about a virtual axis that moves somewhat, as with all the fittings of this invention, and that lies wholly outside the opening of the frame R.

I claim:

1. A pivot hinge usable to support a swingable generally planar panel relative to a stationary frame coplanar with the panel in a closed position of the panel, the hinge comprising:

a panel plate mounted on the panel offset from a plane thereof, provided with a panel pin projecting along an axis away from the panel, and formed with a groove open axially away from the panel and elongated transversely of the axis; and a stationary support plate mounted on the frame offset from the plane of the door in the closed position thereof, provided with a stationary support pin projecting along an axis parallel to the panel-pin axis toward the panel plate and engaged in the panel-plate groove, and formed with a groove open axially toward the panel plate, elongated transversely of the axes, and receiving the panel pin, both pins moving continuously without substantially stopping along the respective grooves between outer and inner ends thereof on swinging of the panel between the closed position and an open position with the panel outside the frame, the support pin lying generally between the support-plate groove and the plane, the grooves being shaped and positioned relative to the pins such that the panel swings on movement between the open and closed positions relative to the frame about a virtual axis offset from the plane with movement of the panel plate through an arc.

2. The pivot hinge defined in claim 1 wherein the pins engage the outer ends of the respective grooves in the closed position of the panel and the pins engage the inner ends of the respective grooves in the open position of the panel, the pins moving toward each other on movement of the panel from the closed to the open position.

3. The pivot hinge defined in claim 1 wherein one of the grooves is generally straight and the other groove is at least partially circularly arcuate.

4. The pivot hinge defined in claim 1 wherein both of the grooves are curved.

5. The pivot hinge defined in claim 1 wherein each of the grooves is provided with a laterally directed opening, whereby the respective pins can be moved out of the grooves through the respective openings.

6. The pivot hinge defined in claim 1 wherein one of the grooves has an end portion of reduced size dimensioned to pinch and hold the respective pin.

7. The pivot hinge defined in claim 1 wherein each of the plates is unitarily formed with the respective groove and the grooves are of uniform widths slightly greater than diameters of the respective pins.

8. The pivot hinge defined in claim 1 wherein at least one of the pins is formed by a nonrotatable axle and a roller carried on the axle and engaging the respective groove.

9. The pivot hinge defined in claim 1 wherein the grooves cross each other as seen axially.

10. The pivot hinge defined in claim 1 wherein the pins are spaced apart parallel to the plane.

* * * * *